US005448136A

United States Patent [19]

Fischer

[11] Patent Number: 5,448,136

[45] Date of Patent: Sep. 5, 1995

[54] METHOD AND APPARATUS FOR CURRENT REGULATION IN A GAS DISCHARGE LAMP

[75] Inventor: Gregory M. Fischer, Cedar Rapids, Iowa

[73] Assignee: Rockwell International Corporation, Seal Beach, Calif.

[21] Appl. No.: 46,825

[22] Filed: Apr. 13, 1993

Related U.S. Application Data

[63] Continuation of Ser. No. 709,942, Jun. 4, 1991, Pat. No. 5,250,877.

[51] Int. Cl.[6] ..... H05B 41/36; H05B 41/39

[52] U.S. Cl. ..... 315/105; 315/98; 315/99; 315/307; 315/DIG. 4

[58] Field of Search ..... 315/98, 99, 105, 106, 315/107, 219, 277, 279, 287, 307, 308, DIG. 4, DIG. 7, 94, 97

[56] References Cited

U.S. PATENT DOCUMENTS

| | | | |
|---|---|---|---|
| 4,010,399 | 3/1977 | Bessone et al. | 315/98 X |
| 4,051,407 | 9/1977 | van der Werf et al. | 315/98 X |
| 4,412,154 | 10/1983 | Klein | 315/287 X |
| 4,412,156 | 10/1983 | Ota | 315/287 X |
| 4,663,570 | 5/1987 | Luchaco et al. | 315/279 X |
| 4,949,015 | 8/1990 | Nilssen | 315/106 X |
| 4,998,046 | 5/1991 | Lester | 315/289 X |
| 5,027,032 | 6/1991 | Nilssen | 315/106 X |
| 5,027,034 | 6/1991 | Ruby et al. | 315/307 X |
| 5,055,747 | 10/1991 | Johns | 315/287 X |
| 5,089,752 | 2/1992 | Pacholok | 315/307 |
| 5,179,326 | 1/1993 | Nilssen | 315/106 |
| 5,216,332 | 6/1993 | Nilssen | 315/106 X |
| 5,235,255 | 8/1993 | Blom | 315/307 X |
| 5,250,877 | 10/1993 | Fischer | 315/107 X |

*Primary Examiner*—David Mis

*Attorney, Agent, or Firm*—Gregory G. Williams; M. Lee Murrah; George A. Montanye

[57] ABSTRACT

A regulated and constrained current source is used to drive the cathodes of a hot cathode gas discharge lamp to provide heating during lamp operation. In one embodiment, the regulated current source is time shared between the lamp cathodes and the lamp arc.

8 Claims, 5 Drawing Sheets

METHOD AND APPARATUS FOR CURRENT REGULATION IN A GAS DISCHARGE LAMP

This application is a Continuation of application Ser. No. 07/709,942, filed on Jun. 4, 1991, now U.S. Pat. No. 5,250,877.

BACKGROUND OF THE INVENTION

1. Field of the Invention

This invention relates to driving the cathodes of hot cathode gas discharge lamps and, in one embodiment, also to driving the arc.

2. Description of the Related Art

Hot cathode gas discharge lamps, particularly the fluorescent lamp variety, are widely used in displays and in interior lighting. Voltage drive circuitry is commonly used to drive the cathodes causing the filaments to heat and thus release enough electrons into the envelope for the lamp to arc from the voltage applied across opposing cathodes. For some applications, especially those in which a lamp is turned on and off thousands of times during its life (such as in back lighted avionics instrument displays), the filaments can be too short-lived.

In accordance with the present invention, there is featured the provision of controlled current drive for the cathodes of such lamps and a concomitant enhancement in the life cycle of such cathodes. Prior art voltage driven cathodes are short lived for two main reasons, namely, (i) excessive peak power in the filament upon cold start-up due to low resistance of cold tungsten and (ii) inconsistent filament power due to contact and mounting resistance in the mechanical structure between the voltage supply and the tungsten filament.

SUMMARY OF THE INVENTION

My solution to both problems is to drive the cathodes with a regulated current. Forcing a regulated level of current through the filament when its resistance is low (the cold condition) does not produce a damaging power surge. Also, series resistance, such as in the connector contacts and filament mounting, does not impact filament power since the regulated current will remain regulated in a series circuit. These and other features, objects, and advantages of the invention will become more apparent upon reference to the following specification, claims, and appended drawings in which:

DETAILED DESCRIPTION

Before proceeding, it should be noted that, although the words "cathode" and "filament", as same apply to lamps, are commonly used synonomously in the art, they will have slightly different meanings herein.

"Cathode", as applied to discharge lamps, will be used generally herein in a common sense manner to signify the lamp structure between the lamp external ports providing access to the electron emitter element. However, there are occasions herein where it is desirable to refer more specifically to the emitter element, as distinguished from other parts of the "cathode", such as mounting structure resistance and/or connection resistance which are in series with the emitter. Thus, when such specificity is desirable, the word "filament" will be used herein to refer to the emitter element of the "cathode".

Figure 1:
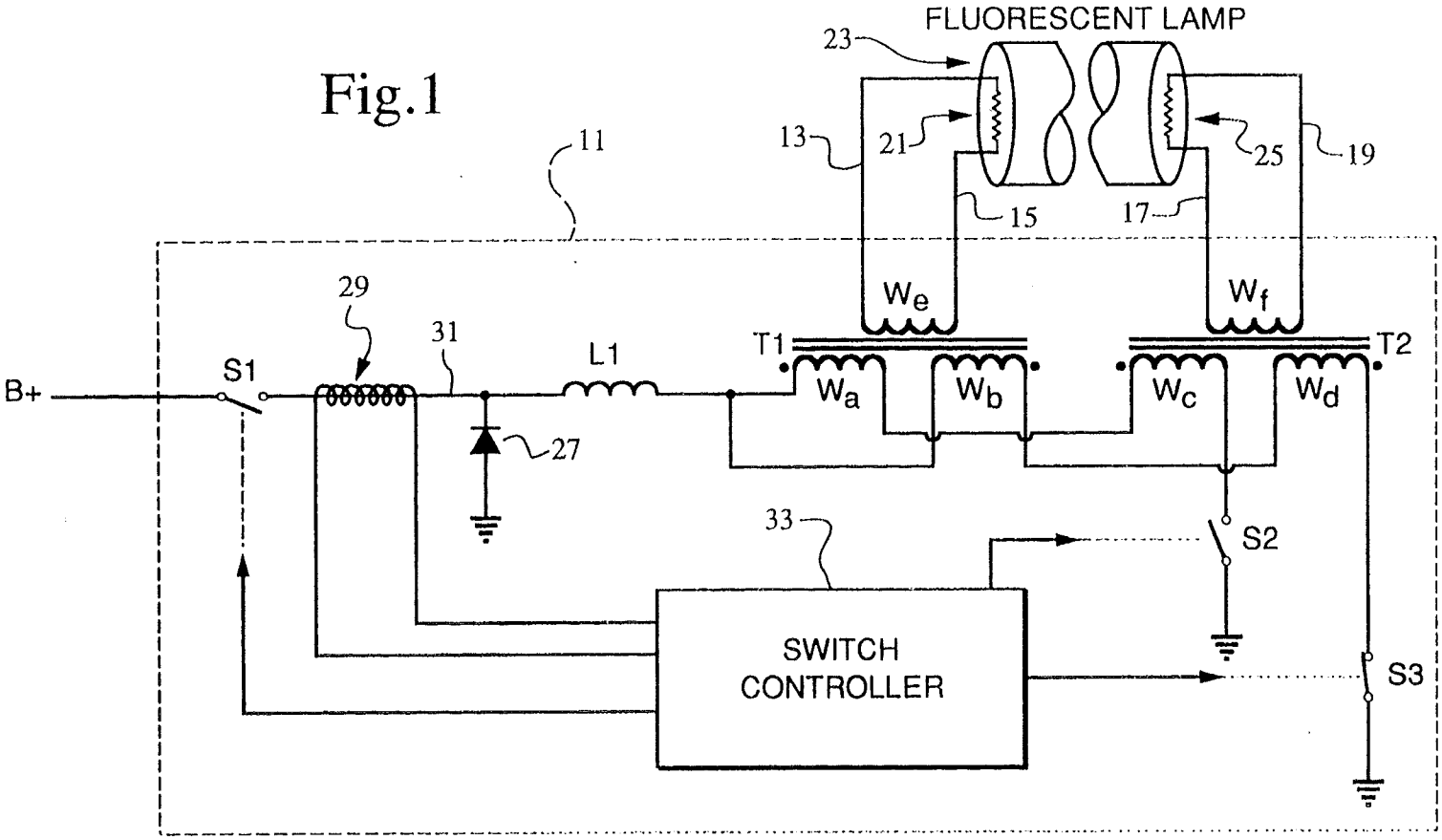
FIG. 1 is a circuit schematic representing one presently preferred inventive embodiment.

Turning now to FIG. 1, therein is represented a current mode control switching current supply 11 having two output transformers T1 and T2 with two primary windings each, namely, $W_a$, $W_b$, $W_c$, and $W_d$, and each with a secondary winding, namely, $W_e$ and $W_f$, the two secondary windings outputting to leads 13, 15, 17, and 19, suitable for enabling connection of secondary $W_e$ across cathode 21 of fluorescent lamp 23 and for enabling connection of secondary $W_f$ across opposite cathode 25.

Still referring to current source 11, a positive voltage source B+ is input via suitable connecting lead and is connected through switch S1 to the cathode of diode 27, the anode of which is connected to ground. Inductance L1 is connected at one end to the cathode of diode 27 and is connected at its other end to the junction of $W_a$ and $W_b$. From said junction, the primaries of transformers T1 and T2 are connected such that $W_a$ and $W_c$ are in series with one another and in series with a switch S2 to ground. Similarly, $W_b$ and $W_d$ are in series with one another and in series with a switch S3 to ground.

A current sense coil 29 is located around lead 31 between B+ and diode 27 and delivers a signal to switch controller 33 that is indicative of the amplitude of current in lead 31. Switch controller 33 coordinates and controls the opening and closing of switches S1, S2, and S3 in response to the feedback signal from sense coil 29.

The dot convention is used in FIG. 1 to indicate phasing of the windings. Phasing $W_a$ and $W_b$ as opposing provides core reset on alternate cycles. Using two like transformers T1 and T2, connected as shown, affords substantially equal or like RMS currents to the two cathodes, even if the two cathodes have different impedances.

Figure 2:
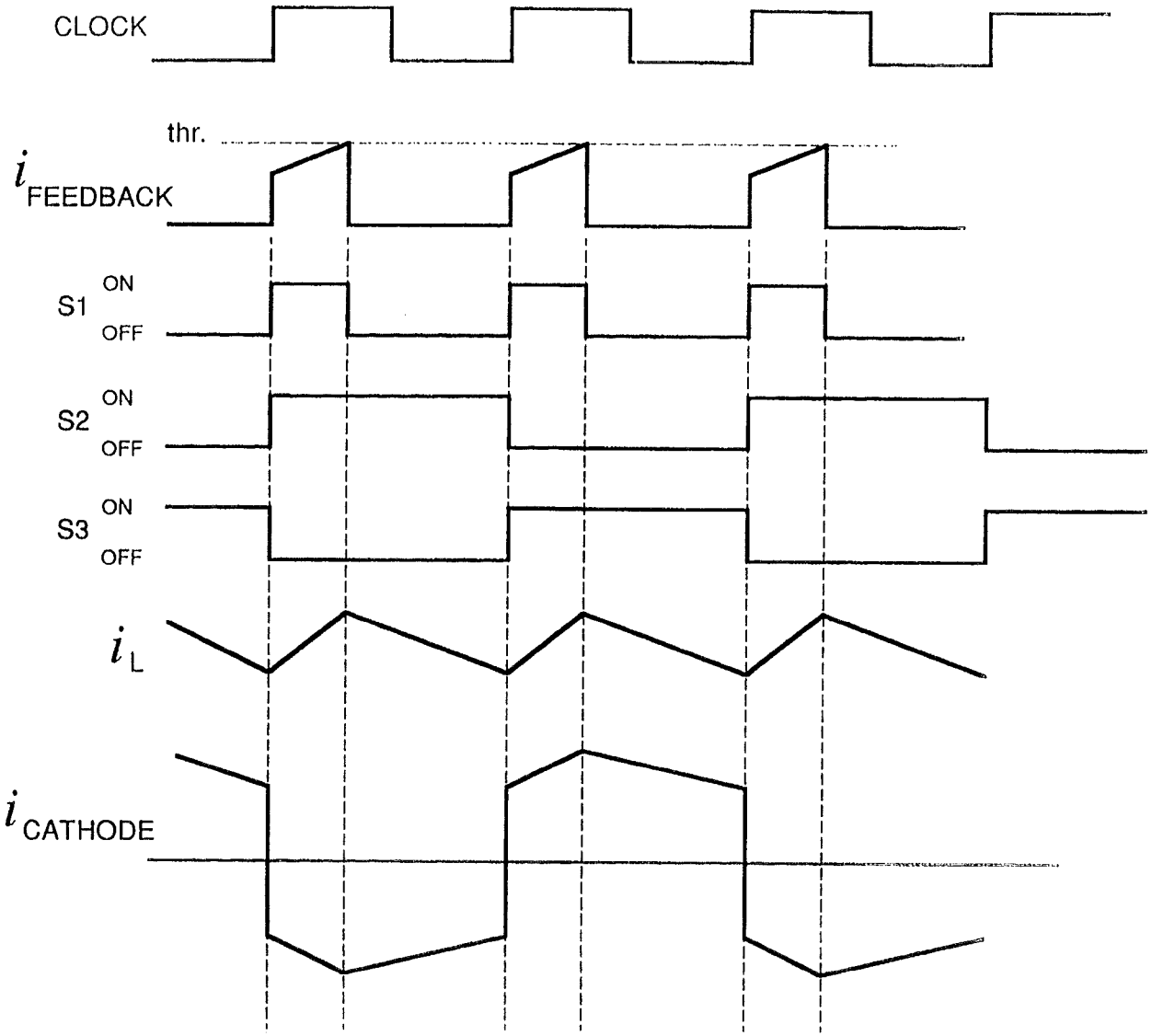
FIG. 2 shows wave forms useful in explaining operation of the FIG. 1 apparatus.

In operation, and with reference now also to FIG. 2, when switch S1 is on (i.e., closed), one of S2 or S3 is also on, and a current $i_L$ flows from B+ through L1, and on through a primary winding of each of T1 and T2, then through the closed one of S2 or S3 to ground. At a point where the feedback signal (designated $i_{feedback}$ in FIG. 2) reaches a predetermined threshold level, controller 33 causes S1 to turn off (i.e., open). Also at this point, inductance L1, which has charged up, begins to discharge and, for a time, continues to supply current $i_L$, now decreasing in amplitude, through the primary windings whose switch to ground is closed. At a time controlled by a clock in controller 33, S1 is turned back on and $i_L$ begins to increase. The states of S2 and S3 are also reversed on the rising edge of this clock. Current $i_L$ increases until the feedback signal reaches the predetermined threshold, and then the cycle repeats.

FIG. 2 shows the resultant current wave form in one of the cathodes. The current in the other cathode is substantially similar (or merely shifted in phase 180° depending on connection) since the transformers T1 and T2 are substantially duplicates of one another. The RMS value of $i_L$ and of each cathode current is thus caused to be substantially constant for a particular value of threshold level for the feedback signal. The RMS cathode currents remain constant regardless of whether the filaments are cold or hot and regardless of the mounting and connection resistance in series with the filaments.

FIG. 2 represents operation during a steady state condition such as when the filaments are hot and have reached their maximum resistance values. When the filaments are cold and are at lower resistance, the charging of L1 will occur somewhat faster, the threshold for the feedback signal will be reached earlier, and the duty cycle of S1 will be somewhat reduced. Nevertheless, the RMS values of the cathode currents are regulated and controlled, and remain substantially equal and constant (±15%) over the range of variation in filament resistance.

In the present embodiment, B+ is typically 28 volts DC; L1 is typically 500 mH; the turns ratio of $W_a$: $W_b$: $W_e$ is typically 1:1:1. A typical example of fluorescent lamp is a T5 lamp operating at 200 mA of arc current. A typical clock frequency is approximately 100 kilohertz. A typical filament current is 250 mA.

Figures 3, 6:
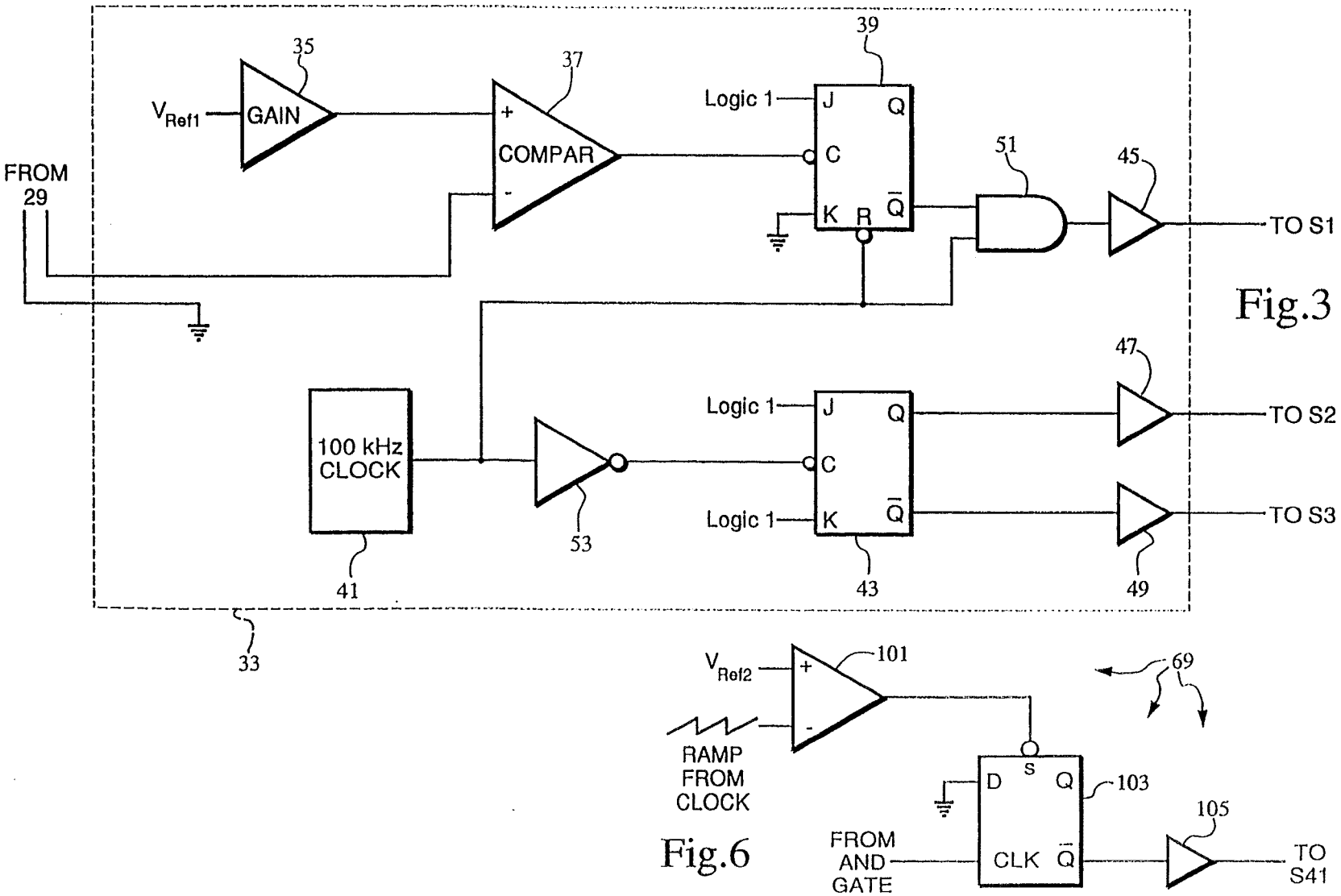
FIG. 3 is a schematic showing part of the FIG. 1 apparatus in more detail.
FIG. 6 is a schematic showing part of the FIG. 4 apparatus in more detail.

Switch controller is embodied as represented in FIG. 3. Item 37 is a comparator, item 41 is an oscillator for generating the clock signal, items 51 and 53 are respectively AND and inverter gates. Items 39 and 43 are J–K type flipflops. Items 45, 47 and 49 are switch drivers. $V_{ref1}$ is a threshold level reference voltage which in the present embodiment is variable for the purpose of reducing cathode current as lamp arc current is increased.

In operation, and with reference now to FIG. 1 and FIG. 3, current feedback from item 29 is compared to $V_{ref1}$ by comparator item 37. With the clock signal in the logic one portion of the clock cycle and switch item S1 in the on state, when the threshold predetermined by $V_{ref1}$ is exceeded, output of item 37 transitions low. This action latches the Q false output of latch item 39 to the logic 0 state. The output of AND gate item 51 is then forced to a logic 0 state. This corresponds to an off condition of switch S1. When the clock signal from oscillator item 41 returns to the logic 0 portion of the clock cycle, latch item 39 is reset such that output Q false is a logic one state. AND gate item 51, however, prevents switch S1 from transitioning to the on state until the logic one portion of the clock cycle. When the clock signal returns to the logic one state, the states of switches S2 and S3 are reversed by flipflop item 43. Also at this point, AND gate 51, with logic one inputs from item 39 and Item 41, allows S1 to return to the on state, where the cycle repeats.

Figure 4:
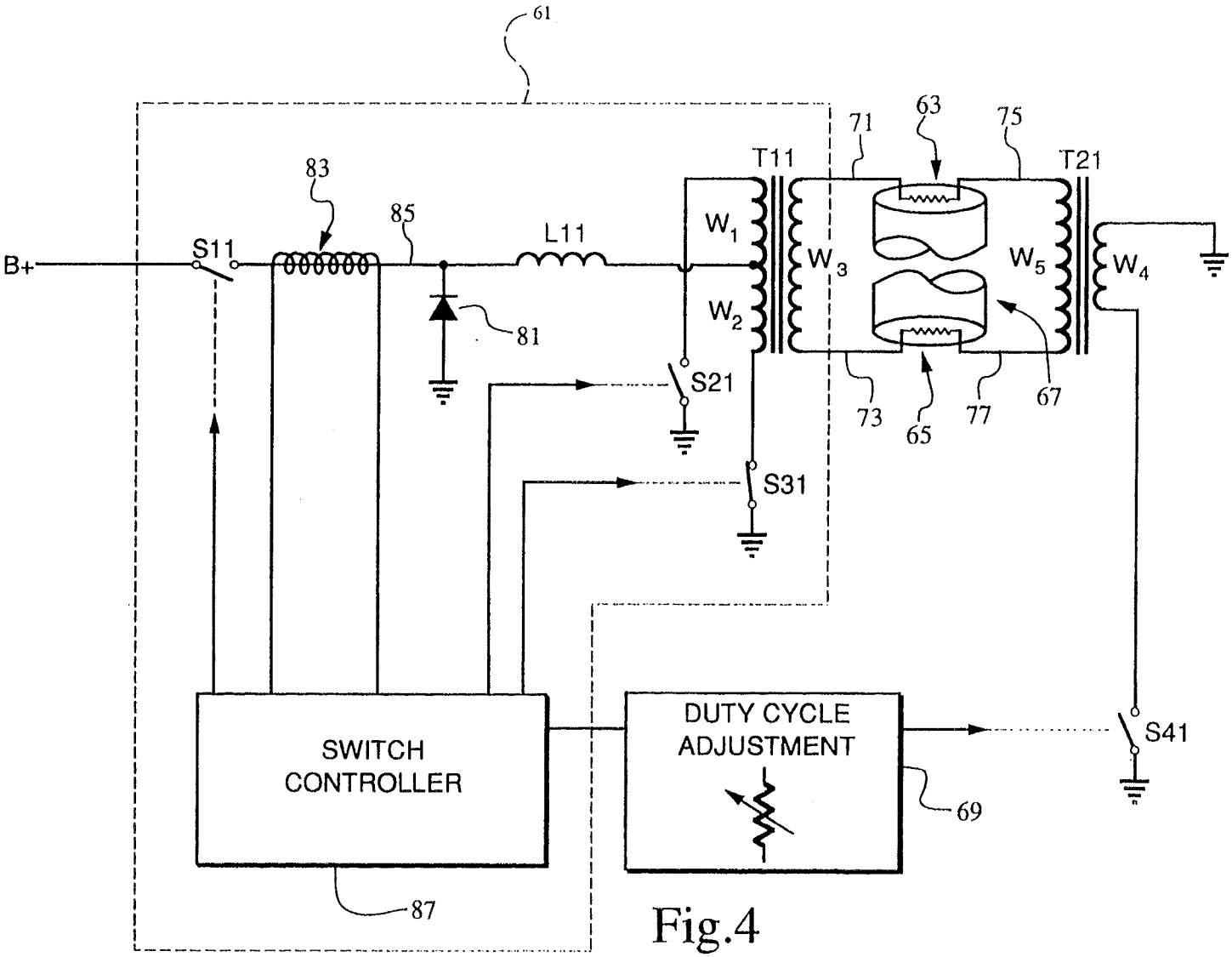
FIG. 4 is a circuit schematic representing a second presently preferred inventive embodiment.

Turning now to FIG. 4, therein is shown a second embodiment wherein a current mode control switching current supply 61 is employed to drive the cathodes 63 and 65 of a fluorescent lamp 67. As in the FIG. 1 apparatus, the cathodes of the fluorescent lamp are driven with a regulated current source, but in the FIG. 4 apparatus, the current source 61 is time shared between the cathodes and the arc as determined by the state of S41. When S41 is operating at a particular duty cycle (as controlled by item 69), the RMS value of cathode current is regulated and substantially fixed regardless of whether the filaments are cold, hot, or in-between. When S41 is operated at a different duty cycle, the RMS value of cathode current is still regulated and substantially constant regardless of filament temperature, but the RMS value of cathode current will be higher or lower than before depending on the change in S41 duty cycle.

More particularly now, current supply 61 has an output transformer T11 with two primary windings, namely, W1 and W2, and with a secondary winding W3, the secondary winding W3 outputting to leads 71 and 73 suitable for enabling connection of secondary W3 to cathodes 63 and 65 of fluorescent lamp 67. Connected to the other ends of cathodes 63 and 65, via leads 75 and 77, is the secondary W5 of transformer T21 whose primary W4 is connected at one end to ground, and at the other end, through switch S41, to ground.

Referring still to current supply 61, a positive voltage source B+ is input via suitable input lead and connected through switch S11 to the cathode of diode 81, the anode of which is connected to ground. Inductance L11 is connected at one end to the cathode of diode 81 and is connected at its other end to the junction between primary windings W1 and W2. The other ends of W1 and W2 are respectively connected in series with switches S21 and S31 to ground.

A current sense coil 83 is located around lead 85 between B+ and diode 81, and delivers to switch controller 87 a signal that is indicative of the amplitude of current in lead 85. Switch controller 87 coordinates and controls the opening and closing of switches S11, S21, and S31 in response to the feedback signal from sense coil 83. Switch S41 is coordinated by controller 87 and also responds to an adjustment in duty cycle from item 69. More particularly, S41 closes when S11 closes, and due to duty cycle adjustment 69, S41 opens at some time prior to the next closing of S11. In this sense, S41 is used to dim the lamp while simultaneously increasing filament power.

Figure 5:
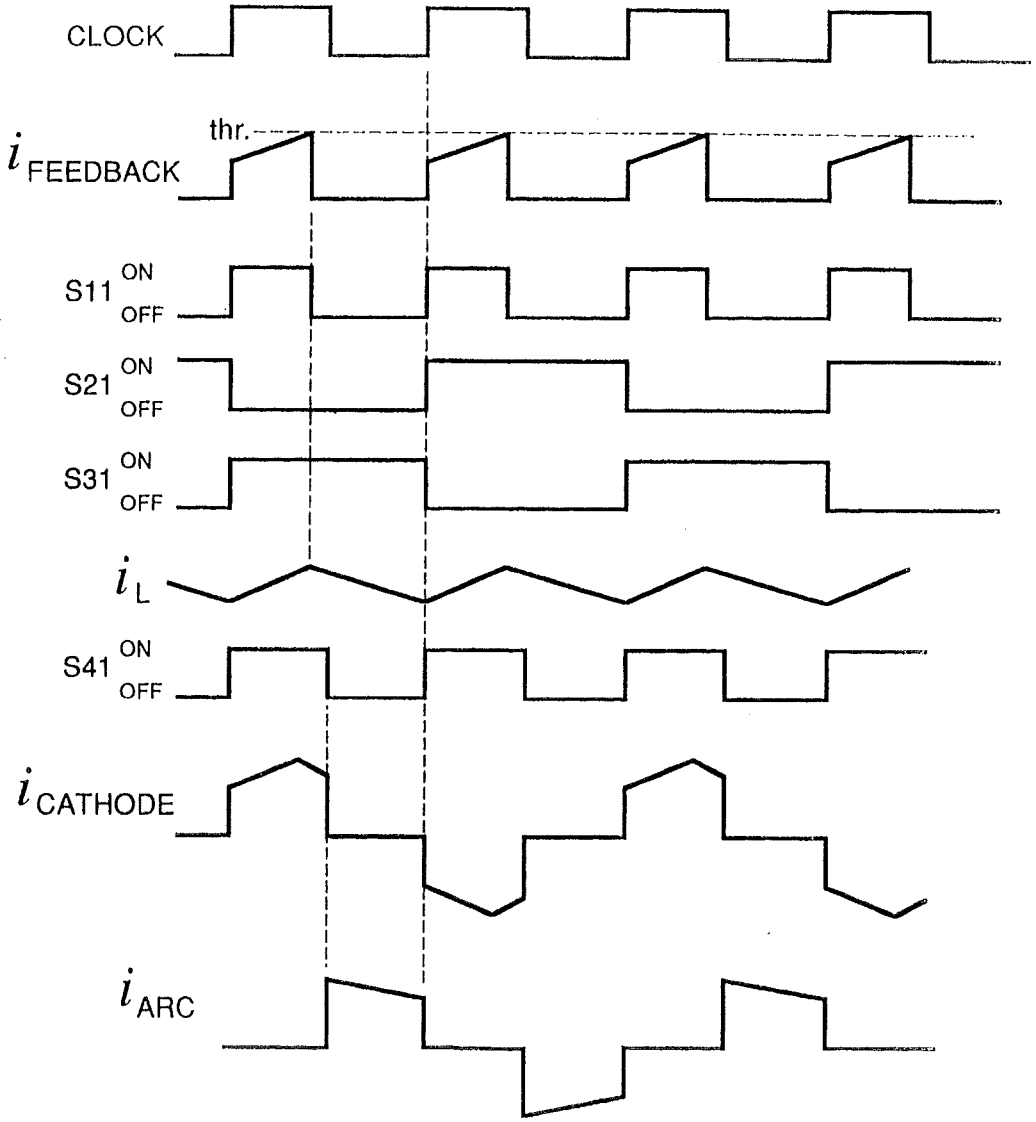
FIG. 5 shows wave forms useful in explaining operation of the FIG. 4 apparatus.

In operation, and with reference now also to FIG. 5, when switch S11 is on (i.e., closed), one of S21 or S31 is also on, and a current $i_L$ flows from B+ through L11, and on through one of W1 or W2, then through the closed one of S21 or S31 to ground. At a point where the feedback signal (designated $i_{feedback}$ in FIG. 5) reaches a predetermined threshold level, controller 87 causes S11 to turn off (i.e., to open). Also at this point, inductance L11, which has charged up, begins to discharge and, for a time, continues to supply current $i_L$, now decreasing in amplitude, through the T11 primary winding whose switch to ground is closed. At a time controlled by a clock in controller 87, S11 is turned back on and $i_L$ begins to increase. Also, the states of S21 and S31 are reversed on the rising edge of this clock. Current $i_L$ increases until the feedback signal reaches its threshold and the cycle repeats.

The RMS value of current in secondary W3 remains substantially constant, regardless of whether the filaments are cold or hot, regardless of the extra resistance in series with the filaments, and regardless of the state of switch S41.

FIG. 5 shows the resultant current wave forms for the cathodes and for the lamp arc and indicates the sharing of current, from W3, between the cathodes and the arc as a function of the state of S41.

When S41 is closed, W5 is essentially a short circuit and the cathodes are essentially in series. During the time that S41 is closed, the lamp arc is extinguished and substantially all supply current is used to drive the cathodes. More particularly, when S41 is closed, the primary W4 of T21 is shorted, the magnetic core takes on a very low permeability, and a magnetic short circuit is created, the result being that W5 acts as a short circuit.

When S41 opens, W4 is opened, the secondary W5 of T21 becomes a high AC impedance, and the output of the current source arcs across the gas discharge lamp 67.

Adjustment item 69 and switch S41 are used to set the lamp brightness. To dim the lamp, S41 is maintained closed for longer time intervals. For a particular setting of adjustment 69, the RMS value of cathode current is substantially constant regardless of filament temperature and regardless of extra resistance in series with the filaments. For a different setting of adjustment 69, the RMS value of cathode current will be different, but will still be regulated and controlled, and in the steady state for such adjustment setting, will be substantially constant. A further advantage of the topology is that the filament heat increases as RMS arc current decreases. Also, the supply 61 may be operated at a fixed frequency and the cathode current is controlled as a by-product of lamp dimming.

In the present implementation of the FIG. 4 apparatus, B+ is approximately 28 volts DC, L11 is typically 400 mH; the turns ratio of W1:W2:W3 is typically 1:1:5. A typical example of fluorescent lamp 67 is a T5 size lamp operating at 250 mA peak arc current. A typical clock frequency is approximately 50 kilohertz. The duty cycle of switch S41 is adjustable between about 20% and 100%. The RMS value of current in secondary winding W3 for a T5 lamp is typically about 250 mA±20% over the range of adjustment in duty cycle of S41. At the low end of the duty cycle range of S41, the RMS value of cathode current is approximately 50 mA and at the high end of the duty cycle range of S41, the RMS value of cathode current is approximately 250 mA.

Switch controller 87 is substantially the same as switch controller 33 of FIG. 1, the difference being that $V_{ref1}$ is held constant in controller 87, but is preferably adjustable in item 33.

Duty cycle adjustment 69 is embodied as represented in FIG. 6. Item 101 is a comparator, item 103 is a D type flipflop, and item 105 is a switch driver. $V_{ref2}$ is a variable reference which corresponds to desired lamp brightness and resultant filament power. A ramp voltage is developed by a clock oscillator in item 87, like oscillator item 41 of FIG. 3, the ramp being synchronized to the clock.

In operation, and with reference now to FIG. 3 and FIG. 6, D flipflop 103 is set, to a state where Q false output is logic 1, by the rising edge of output of an AND gate in item 87 corresponding to item 51 in FIG. 3, said AND gate output corresponding to the on state of switch S11. Correspondingly, switch S41 is latched to the "on" state. Switch S41 will remain in the "on" state until the time when the ramp voltage input to comparator item 101 exceeds the reference voltage $V_{ref2}$. When the ramp voltage exceeds $V_{ref2}$, output of item 101 takes a logic 0 state, and sets the latch item 103 such that Q false is now logic 0. This corresponds to switch item S41 being in the off state. The cycle repeats when the output from the AND gate (corresponding to item 51) returns to logic 1, which sets latch item 103 Q false output back to a logic 1 state.

Thus, while particular embodiments of the present invention have been shown and/or described, it is apparent that changes and modifications may be made therein without departing frown the invention in its broader aspects. The aim of the appended claims, therefore, is to cover all such changes and modifications as fall within the true spirit and scope of the invention.

What is claimed is:

1. Apparatus for driving at least one filament of a hot cathode gas discharge lamp, the apparatus comprising:

first means for supplying a regulated and constrained current at a predetermined current level for control of filament heating during lighted operation and having an input means and an output means, said first means for supplying a regulated and constrained current utilizing a feedback signal to regulate and constrain said current, feedback means for providing said feedback signal, second means for connecting said output means to the lamp cathode, and third means for connecting said input means to a voltage source.

2. Apparatus as defined in claim 1 wherein said first means comprises a current mode control switching current supply with a control feedback loop.

3. Apparatus as defined in claim 2 wherein said output means comprises a transformer secondary winding.

4. Apparatus as defined in claim 3 wherein said second means comprises means suitable for enabling connection of said secondary across said filament.

5. For use in driving at least one filament of a hot cathode gas discharge lamp, apparatus comprising:

feedback means for providing a feedback signal, a regulated and constrained current source, utilizing said feedback signal and means for connecting said source to the filament.

6. Apparatus as defined in claim 5 wherein said regulated current source comprises a current mode control switching current supply with a control feedback loop.

7. Apparatus as defined in claim 6 wherein an supply includes a transformer for providing the output current.

8. A process comprising:

providing a hot cathode gas discharge lamp with at least one filament therein;

driving at least one filament, with a regulated and constrained current source for heating said filament during operation of the lamp by utilizing a feedback signal; and providing said feedback signal.

* * * * *